US011255330B2

(12) United States Patent
Nishida et al.

(10) Patent No.: US 11,255,330 B2
(45) Date of Patent: Feb. 22, 2022

(54) PUMP END PLATE MANUFACTURING METHOD AND PUMP

(71) Applicant: TAIHO KOGYO Co., Ltd., Toyota (JP)

(72) Inventors: Syuhei Nishida, Toyota (JP); Satoshi Ikeda, Toyota (JP); Kazuya Mizuno, Toyota (JP); Ken Nakamuta, Toyota (JP)

(73) Assignee: TAIHO KOGYO Co., Ltd., Toyota (JP)

( * ) Notice: Subject to any disclaimer, the term of this patent is extended or adjusted under 35 U.S.C. 154(b) by 729 days.

(21) Appl. No.: 16/076,034

(22) PCT Filed: Jan. 31, 2017

(86) PCT No.: PCT/JP2017/003412
§ 371 (c)(1),
(2) Date: Aug. 7, 2018

(87) PCT Pub. No.: WO2017/145669
PCT Pub. Date: Aug. 31, 2017

(65) Prior Publication Data

US 2021/0148364 A1 May 20, 2021

(30) Foreign Application Priority Data

Feb. 25, 2016 (JP) ..... JP2016-034110

(51) Int. Cl.
*F04C 2/344* (2006.01)
*F04C 29/02* (2006.01)
(Continued)

(52) U.S. Cl.
CPC ..... *F04C 29/00* (2013.01); *F04C 2/086* (2013.01); *F04C 2/344* (2013.01); *F04C 18/086* (2013.01);
(Continued)

(58) Field of Classification Search
CPC .... F04C 2/344; F04C 2/3441; F04C 18/3441; F04C 2230/00; F04C 2/086; F04C 18/086;
(Continued)

(56) References Cited

U.S. PATENT DOCUMENTS 2,353,545 A * 7/1944 Caserta ..... F02B 1/00 137/493.3
2,634,904 A * 4/1953 Clerc ..... F04C 29/00 418/96
(Continued)

FOREIGN PATENT DOCUMENTS

CN 201714667 U 1/2011
JP 52-68852 A 6/1977
(Continued)

OTHER PUBLICATIONS

Extended European Search Report dated Feb. 11, 2019 in European Patent Application No. 17756111.5, 10 pages.
(Continued)

*Primary Examiner* — Deming Wan
(74) *Attorney, Agent, or Firm* — Oblon, McClelland, Maier & Neustadt, L.L.P.

(57) ABSTRACT

A manufacturing method of an end plate of a pump that can remove a sag includes: punching a workpiece from a plate material, the workpiece being the end plate including a mounting seat including a fastener; forming a pressed trace surface by pressing an outer edge of an outer surface, when a surface, of both front and back surfaces of the punched workpiece, further from a sag formed on a cut end surface is the outer surface, and a surface, of both front and back surfaces of the punched workpiece, nearer to the sag is an inner surface. A section of the pressed trace surface disposed along an outer edge of the mounting seat is a fastening section. A section of the pressed trace surface other than the
(Continued)

fastening section is a non-fastening section. A radial width of the fastening section is shorter than that of the non-fastening section.

5 Claims, 10 Drawing Sheets

(51) Int. Cl.

| | |
|---|---|
| ***F01C 21/08*** | (2006.01) |
| ***F01C 19/06*** | (2006.01) |
| ***F04C 2/08*** | (2006.01) |
| ***F04C 18/08*** | (2006.01) |
| ***F04C 29/00*** | (2006.01) |

(52) U.S. Cl.
CPC .... *F04C 2230/604* (2013.01); *F04C 2240/30* (2013.01); *F04C 2240/805* (2013.01)

(58) Field of Classification Search
CPC ... F01C 21/0809; F01C 21/0881; F01C 19/06
See application file for complete search history.

(56) References Cited

U.S. PATENT DOCUMENTS

| | | | | |
|---|---|---|---|---|
| 4,905,556 | A * | 3/1990 | Haack | B21D 28/16 72/335 |
| D875,141 | S | 2/2020 | Nishida et al. | |

FOREIGN PATENT DOCUMENTS

| | | | |
|---|---|---|---|
| JP | 58-167780 | U | 11/1983 |
| JP | 8-177769 | A | 7/1996 |
| JP | 2009-7951 | A | 1/2009 |
| JP | 1572429 | S | 8/2017 |
| JP | 1572430 | S | 8/2017 |
| JP | 1583829 | S | 8/2017 |
| JP | 1585358 | S | 9/2017 |
| JP | 1585359 | S | 9/2017 |
| JP | 1585360 | S | 9/2017 |
| JP | 1585361 | S | 9/2017 |
| KR | 10-2015-0003433 | A | 1/2015 |
| WO | WO 2009/109282 | A1 | 9/2009 |

OTHER PUBLICATIONS

International Search Report dated Mar. 28, 2017 in PCT/JP2017/003412 (with English translation), 5 pages.
International Preliminary Report on Patentability and Written Opinion dated Sep. 7, 2018 in PCT/JP2017/003412 (with English translation), 11 pages.
European Office Action issued in European Patent Application No. 17 756 111.5 dated Dec. 1, 2021.

* cited by examiner

PUMP END PLATE MANUFACTURING METHOD AND PUMP

TECHNICAL FIELD

The present invention relates to a pump end plate manufacturing method and a pump.

BACKGROUND ART

A housing of a vane pump of Patent Document 1 has a housing body with a bottomed cylindrical shape and an end plate that seals an opening portion of the housing body. A manufacturing method of an end plate includes a punching step and a polishing step. In the punching step, a workpiece that becomes the end plate is manufactured by punching a plate material. A sag is formed in a cutting surface of the workpiece after the punching step. If the workpiece is used as the end plate with the sag still remaining, sealability of a mating surface (sealing interface) between the end plate and the opening portion of the housing body will deteriorate. Thus, in the polishing step which is after the punching step, the sag is removed by polishing an inner surface (surface on the mating surface side) of the workpiece.

RELATED-ART DOCUMENTS

Patent Documents

Patent Document 1: Japanese Patent Application Publication No. 2009-7951 (JP 2009-7951 A)

SUMMARY OF THE INVENTION

Problem to be Solved by the Invention

However, in the polishing step, the workpiece needs to be polished from the cut end surface to a portion that has no sag. Thus, the polishing step is complex. An object of the present invention therefore is to provide a manufacturing method of an end plate of a pump that can easily remove the sag. Additionally, an object of the present invention is to provide the pump in which sealability of the mating surface is easily ensured.

Means for Solving the Problem

In order to solve the above problem, a manufacturing method of an end plate of a pump of the present invention is a manufacturing method of an end plate of a pump including a punching step of punching a workpiece from a plate material, the workpiece being the end plate that has a mounting seat in which a fastener is inserted. The method is characterized by including a pressing step of forming a pressed trace surface by pressing an outer edge of an outer surface, when a surface, of both front and back surfaces of the punched workpiece, that is further from a sag that is formed on a cut end surface is the outer surface, and a surface, of both front and back surfaces of the punched workpiece, that is nearer to the sag is an inner surface. A section of the pressed trace surface which is disposed along an outer edge of the mounting seat is a fastening section. A section of the pressed trace surface which is other than the fastening section is a non-fastening section. A radial width of the fastening section is shorter than a radial width of the non-fastening section.

Additionally, a pump of the present invention is characterized by including: a cylindrical housing body that includes an opening portion in at least one end in an axial direction; and an end plate which has an inner surface that seals the opening portion, an outer surface that is disposed on the opposite side of the inner surface in the axial direction, and a pressed trace surface that is disposed along an outer edge of the outer surface. The pump has a housing in which a pump chamber is defined.

Effects of the Invention

In the manufacturing method of an end plate of a pump of the present invention, a sag can easily be removed by deforming the material of the workpiece near the cut end surface, when the pressed trace surface is formed in the pressing step. Additionally, the radial width of the fastening section is shorter than the radial width of the non-fastening section. Thus, a bearing surface of the fastener is easily ensured on the mounting seat. Additionally, the material of the workpiece can be sufficiently deformed since the radial width of the non-fastening section is long. Thus, the sag can be reliably removed.

Additionally, in the pump of the present invention, the sag hardly remains on the outer edge of the inner surface of the end plate. Thus, sealability of the mating surface (sealing interface) between the inner surface of the end plate and the opening portion of the housing body is easily ensured.

MODES FOR CARRYING OUT THE INVENTION

Figure 1:
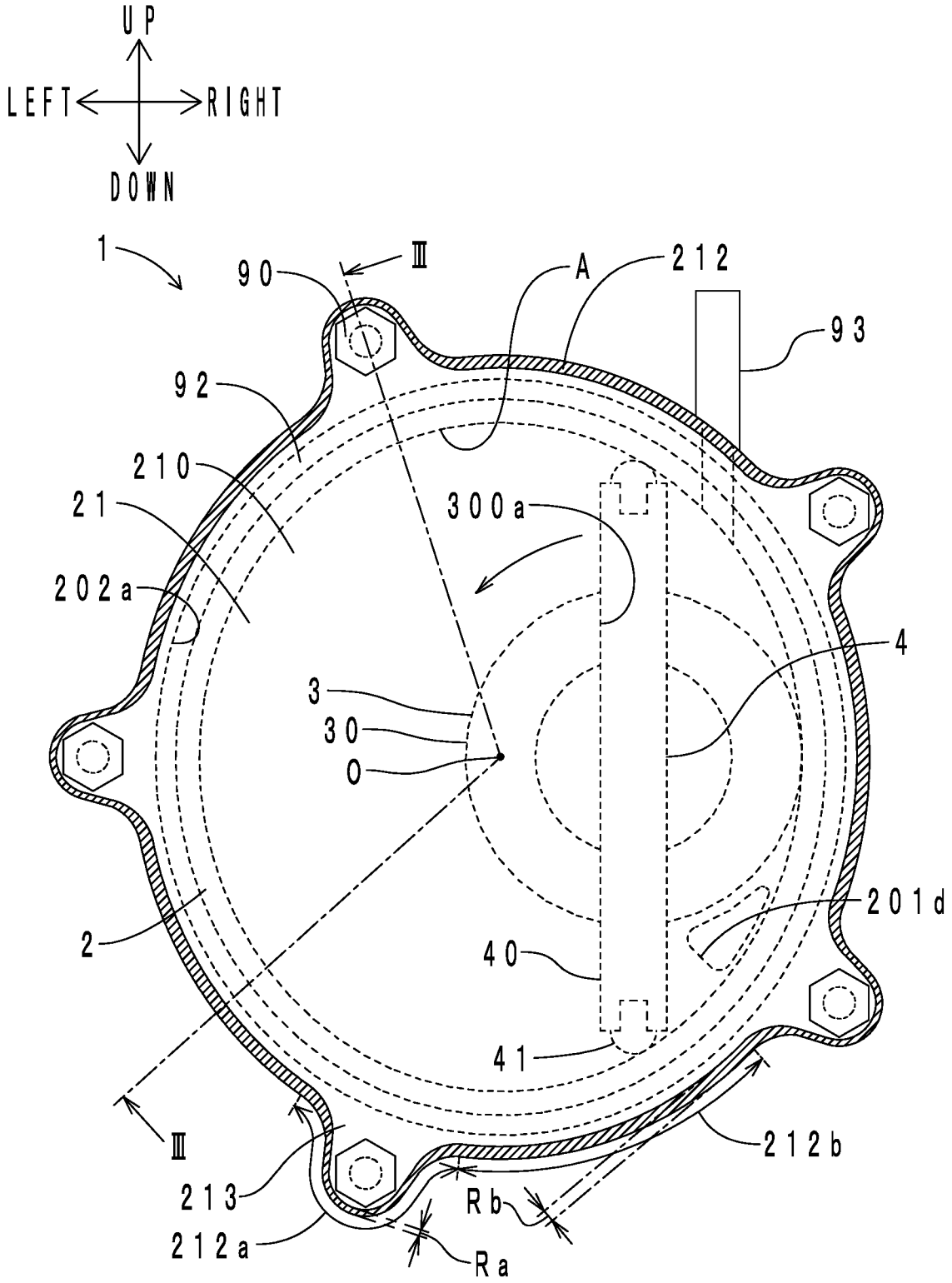
FIG. 1 is a transparent front view of a vane pump of an embodiment of the present invention.
Figure 2:
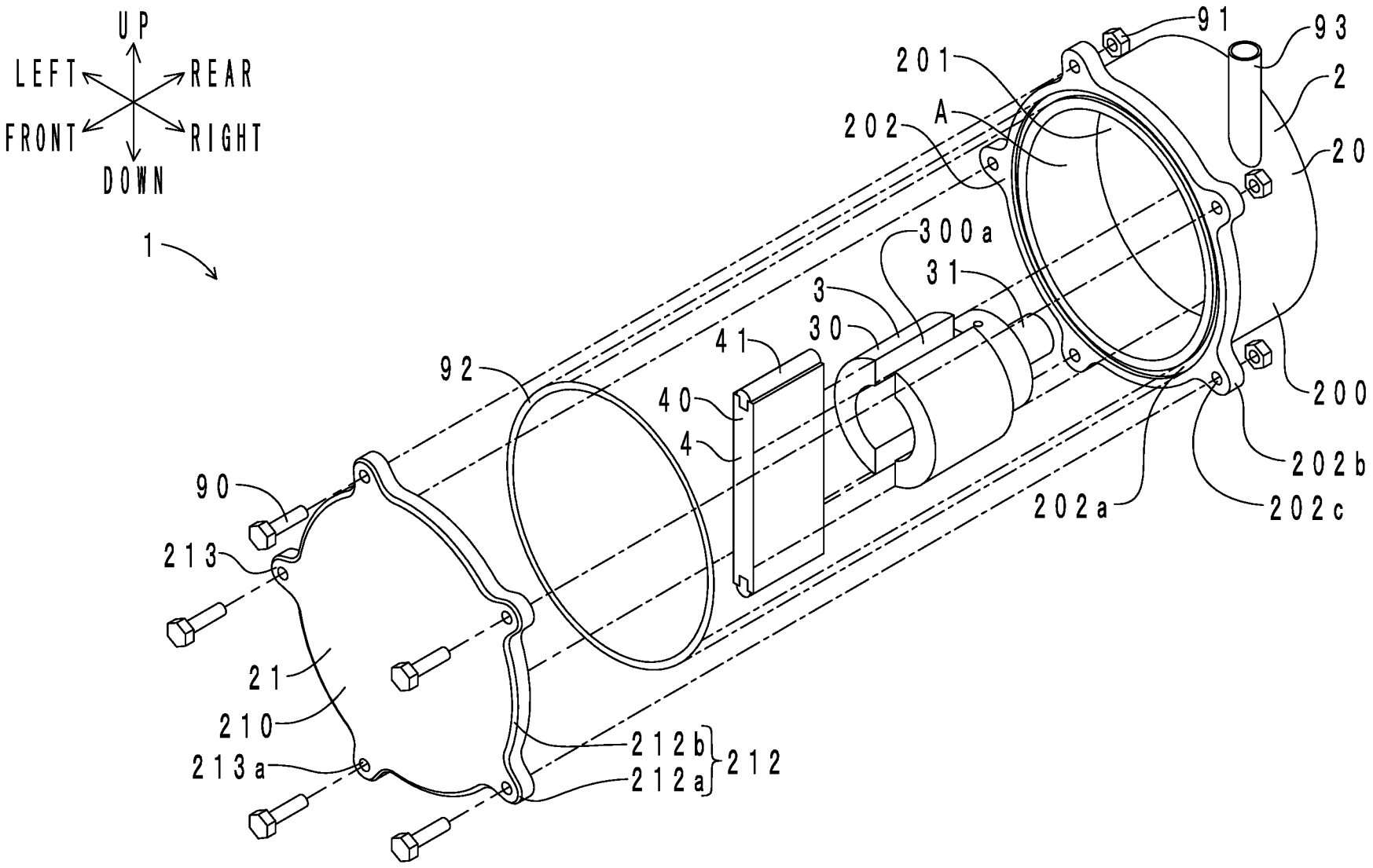
FIG. 2 is an exploded perspective view of the vane pump.
Figure 3:
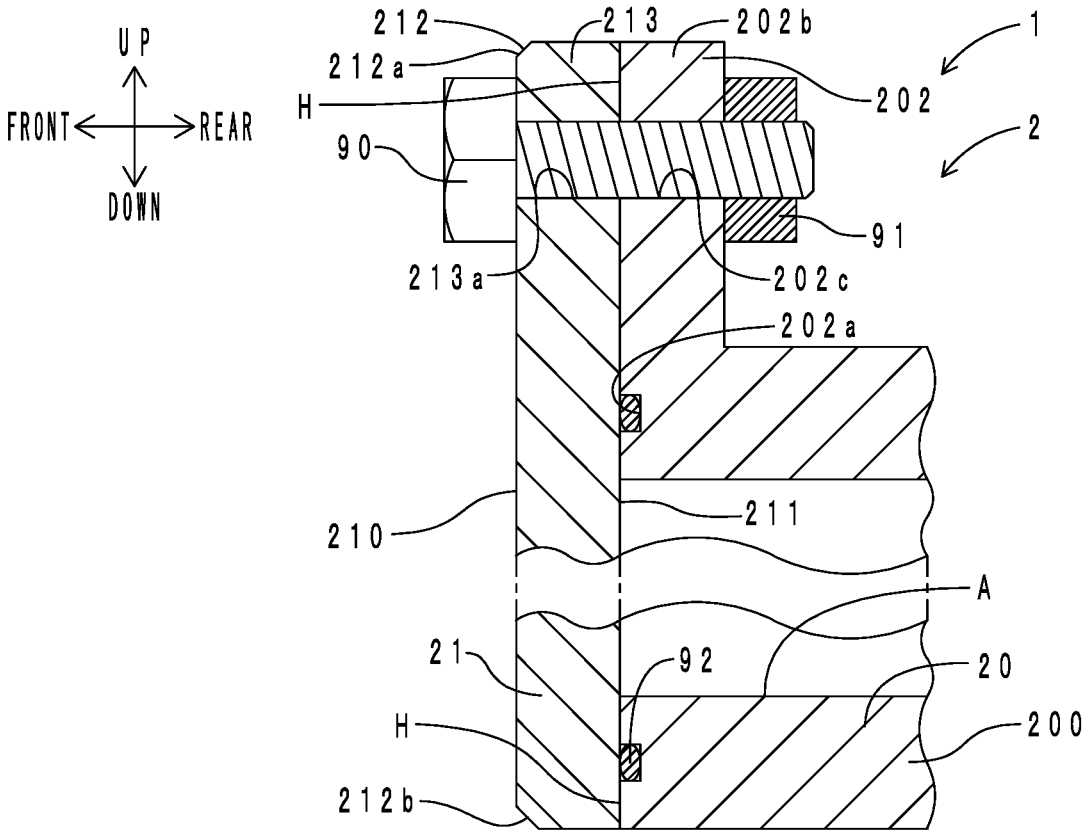
FIG. 3 is a sectional view taken along line in FIG. 1.

An embodiment of a manufacturing method of an end plate of a pump of the present invention (hereinafter referred to as "the manufacturing method of an end plate") and a pump will be described below. FIG. 1 is a transparent front view of a vane pump of the present embodiment. FIG. 2 is an exploded perspective view of the vane pump. FIG. 3 is a sectional view taken along line in FIG. 1.

<Configuration of Vane Pump>

First, the configuration of the vane pump of the present embodiment will be described. A vane pump 1 is coupled to a booster (not shown) of a braking system. The vane pump 1 is included in the concept of the "pump" of the present invention. The vane pump 1 is a negative pressure source of the booster. The vane pump 1 has a housing 2, a rotor 3, and a vane 4.

Hereafter, the axial direction (front-rear direction) means the axial direction of the housing 2. The circumferential direction means the circumferential direction that has the center O of an ellipse as the center when viewed in the axial direction of the housing 2. The radial direction means the radial direction that has the center O of the ellipse as the center when viewed in the axial direction of the housing 2.

[Housing 2]

The housing 2 is fixed to a side surface of an engine (not shown). The housing 2 has a housing body 20, an end plate 21, and a pump chamber A. The housing body 20 has a bottomed elliptic cylindrical shape. The housing body 20 has a peripheral wall portion 200, a bottom wall portion 201, and an opening portion 202.

The peripheral wall portion 200 has an elliptic cylindrical shape. The bottom wall portion 201 is disposed in the rear end of the peripheral wall portion 200. An exhaust hole 201*d* is opened in the bottom wall portion 201.

The opening portion 202 is formed in the front end of the peripheral wall portion 200. The opening portion 202 has a groove 202*a*, and a plurality of mounting seats 202*b*. The groove 202*a* has a ring shape. The groove 202*a* is formed in the front end surface of the opening portion 202 so as to extend inwardly. A rubber sealing member 92 is housed in the groove 202*a*. The sealing member 92 is an O-ring.

The mounting seats 202*b* are disposed in the radial outer side of the groove 202*a*. The mounting seats 202*b* are disposed at prescribed intervals in the circumferential direction along the rim of the opening portion 202. An insertion hole 202*c* is formed in the mounting seat 202*b*. The insertion hole 202*c* extends though the mounting seat 202*b* in the front-rear direction.

The end plate 21 has an elliptic plate shape. The end plate 21 seals the opening portion 202. The end plate 21 has an outer surface (front surface) 210, an inner surface (rear surface) 211, a pressed trace surface 212, and a plurality of mounting seats 213.

The mounting seats 213 are disposed at prescribed intervals in the circumferential direction along the outer edge of the end plate 21. An insertion hole 213*a* is formed in the mounting seat 213. The insertion hole 213*a* extends through the mounting seat 213 in the front-rear direction. The insertion hole 213*a* and the insertion hole 202*c* are arranged side by side in the front-rear direction. A bolt 90 passes through the insertion hole 213*a* and the insertion hole 202*c* in the front-rear direction. The bolt 90 is included in the concept of a "fastener" of the present invention. A nut 91 is screwed to the rear end (passing-through end) of the bolt. The end plate 21 is fixed to the opening portion 202 by the plurality of bolts 90 and the plurality of nuts 91 in this way. Additionally, the elastically deformed sealing member 92 is interposed between the end plate 21 and the opening portion 202.

As shown by the hatching in FIG. 1, the pressed trace surface 212 is disposed along the outer edge of the outer surface 210. As shown in FIG. 3, the pressed trace surface 212 has a planar chamfered shape. The pressed trace surface 212 has a surface tapered towards the front.

The pressed trace surface 212 is defined into a plurality of fastening sections 212*a* and a plurality of non-fastening sections 212*b*. The fastening section 212*a* is disposed along the outer edge of the mounting seat 213. The non-fastening section 212*b* is disposed along the outer edge of the portion other than the mounting seat 213. As shown in FIG. 1, a radial width (minimum value of the radial width) Ra of the fastening section 212*a* is shorter than a radial width (minimum value of the radial width) Rb of the non-fastening section 212*b*. The pump chamber A is defined inside the housing 2. The pump chamber A has an elliptic shape when viewed from the front side or the rear side. An intake cylinder 93 is coupled to the pump chamber A.

[Rotor 3, Vane 4]

The rotor 3 has a rotor body 30 and a shaft portion 31. The rotor body 30 is housed in the pump chamber A. The rotor body 30 has a pair of rotor grooves 300*a*. The rotor grooves 300*a* are disposed facing each other in the diameter direction, that is, disposed at 180 degrees from each other. The rotor grooves 300*a* extend through the rotor body 30 in the diameter direction.

The shaft portion 31 is continued rearward from the rotor body 30. The shaft portion 31 extends through the bottom wall portion 201 in the front-rear direction. The shaft portion 31 is coupled to a camshaft (not shown) of an engine via a coupling (not shown) and an oil supply joint (not shown). The shaft portion 31 is rotatable around its axis. Thus, the rotor 3 is rotatable around the axis of the shaft portion 31.

The vane 4 has a vane body 40 and a pair of caps 41. The vane body 40 is housed in the pump chamber A. The vane body 40 is rotatable with the rotor 3. The vane body 40 can move reciprocally in the diameter direction along the rotor grooves 300*a*. The vane body 40 can define the pump chamber A into a plurality of operation chambers, according to the rotation angle. The caps 41 are disposed on both ends of the vane body 40 in the diameter direction. The cap 41 is in sliding contact with the inner peripheral surface of the peripheral wall portion 200.

As the vane 4 rotates, the volume of each of the operation chambers of the pump chamber A increases or decreases. At this time, the vane pump 1 draws air into the operation chamber from the booster via the intake cylinder 93. The vane pump 1 also exhausts air to the outside from the operation chamber via the exhaust hole 201*d*.

<Manufacturing Method of End Plate of Vane Pump>

Next, the manufacturing method of an end plate of a vane pump of the present embodiment will be described. The manufacturing method includes a punching step and a pressing step.

[Punching Step]

Figure 4:
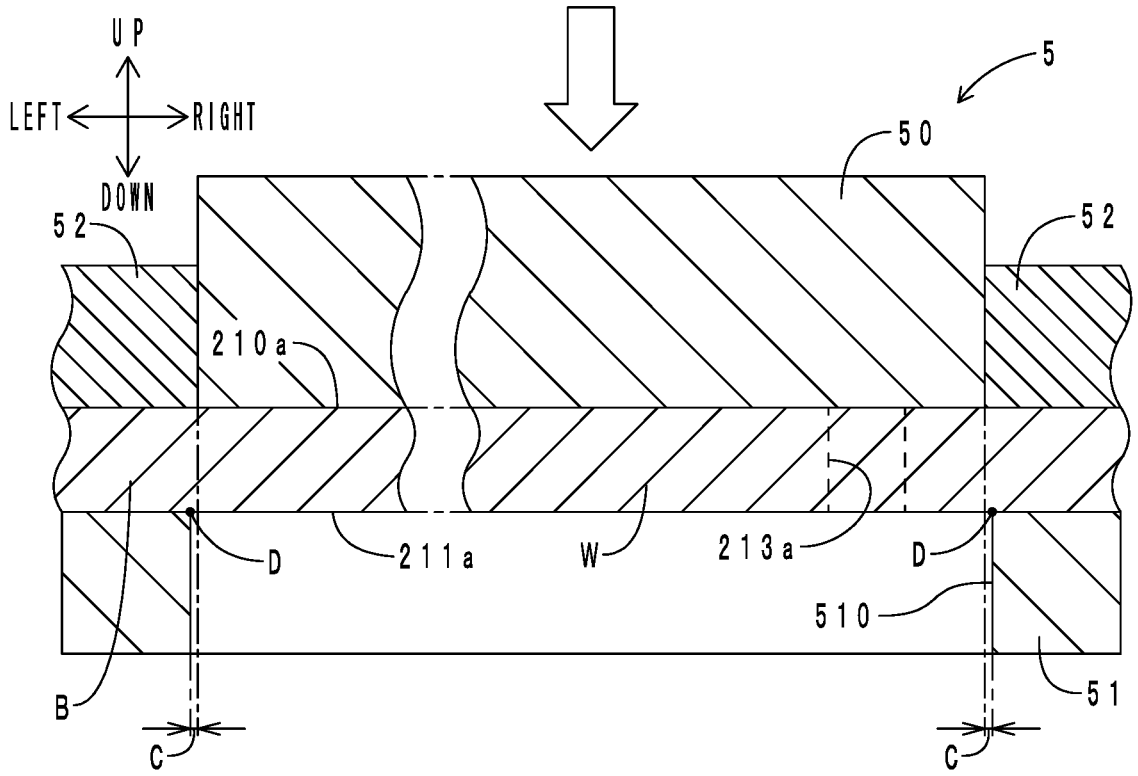
FIG. 4 is a schematic diagram of a punching step of a manufacturing method of an end plate of a vane pump of the embodiment of the present invention.

FIG. 4 is a schematic diagram of the punching step of the manufacturing method of an end plate of the present embodiment. The upper side of the end plate 21 shown in FIG. 3 corresponds to the right side of a workpiece W shown in FIG. 4. The lower side of the end plate 21 shown in FIG. 3 corresponds to the left side of the workpiece W shown in FIG. 4. In this step, the workpiece W that becomes the end plate 21 is punched from a plate material by press punching work.

As shown in FIG. 4, a mold 5 has a punch 50, a die 51, and a stripper 52. First, a plate material B is set on the upper surface of the die 51. Next, the upper surface of the plate material B is held down by the stripper 52. The workpiece W is then punched from the plate material B by the punch 50. Here, a prescribed clearance C is set between the rim of a punch insertion hole 510 of the die 51 and the outer edge of the punch 50. Thus, when the workpiece W is punched, a sag occurs near a portion D of the lower surface of the workpiece W. The portion D abuts on the rim of the punch insertion hole 510. Afterwards, the insertion holes 213*a* (see FIG. 3) are bored into the workpiece W as shown by the dotted line in FIG. 4, using a different mold.

[Pressing Step]

Figure 5:
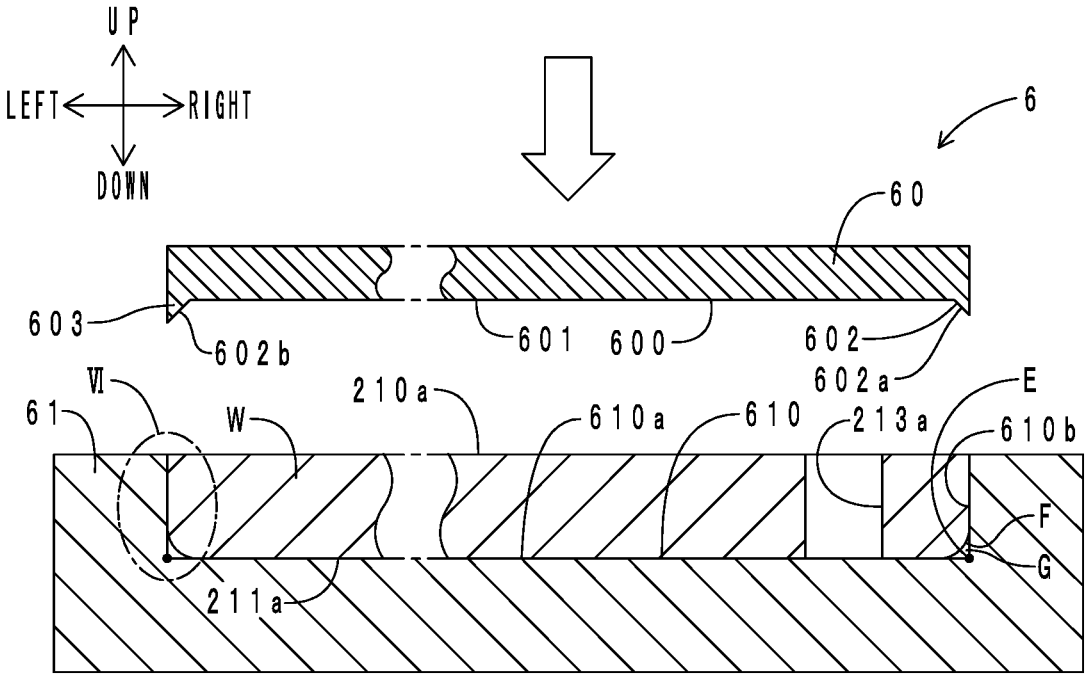
FIG. 5 is a schematic diagram of a workpiece arrangement step of the manufacturing method.

This step includes a workpiece arrangement step and a filling step. FIG. 5 is a schematic diagram of the workpiece arrangement step of the manufacturing method of an end plate of the present embodiment. As shown in FIG. 5, a mold 6 has a pressing member 60 and a jig 61. The jig 61 has a recessed portion 610 that is recessed so as to open upward. The shape of the recessed portion 610 seen from above is the same as the shape of the end plate 21 seen from the front side as shown in FIG. 1. A bottom surface 610*a* of the recessed portion 610 has a flat surface. The depth of the recessed portion 610 in the up-down direction is the same as the plate thickness of the end plate 21 in the front-rear direction shown in FIG. 3.

The pressing member 60 is accessible to the recessed portion 610 from above. The shape of a lower surface (pressing surface) 600 of the pressing member 60 is the same as the shape of the end plate 21 seen from the front side as shown in FIG. 1. The lower surface 600 has a flat surface portion 601 and a protruded portion 603.

The flat surface portion 601 has a flat surface. A prescribed uneven pattern (knurled pattern, not shown) is disposed on the flat surface portion 601. The protruded portion 603 is protruded downward along the outer edge of the flat surface portion 601. A pressed trace surface forming portion 602 is provided on the inner peripheral surface of the protruded portion 603 (inclined surface to the flat surface portion 601). The pressed trace surface forming portion 602 has a planar chamfered shape. The pressed trace surface forming portion 602 has a surface tapered upwards. That is, the pressed trace surface forming portion 602 and the pressed trace surface 212 shown in FIG. 1 are symmetric across a mold surface. The pressed trace surface forming portion 602 is defined into a plurality of fastening section forming portions 602*a* and a plurality of non-fastening section forming portions 602*b*. The fastening section forming portion 602*a* corresponds to the fastening section 212*a* shown in FIG. 3. The non-fastening section forming portion 602*b* corresponds to the non-fastening section 212*b* shown in FIG. 3.

An outer surface (upper surface) 210*a* of the workpiece W corresponds to the outer surface 210 of the end plate 21 shown in FIG. 3. An inner surface (lower surface) 211*a* of the workpiece W corresponds to the inner surface 211 of the end plate 21 shown in FIG. 3. In this step, as shown in FIG. 5, the workpiece W is disposed in the recessed portion 610 of the jig 61 so that the outer surface 210*a* is the surface side (upper side). The inner surface 211*a* of the workpiece W abuts on the bottom surface 610*a*.

Figure 6:
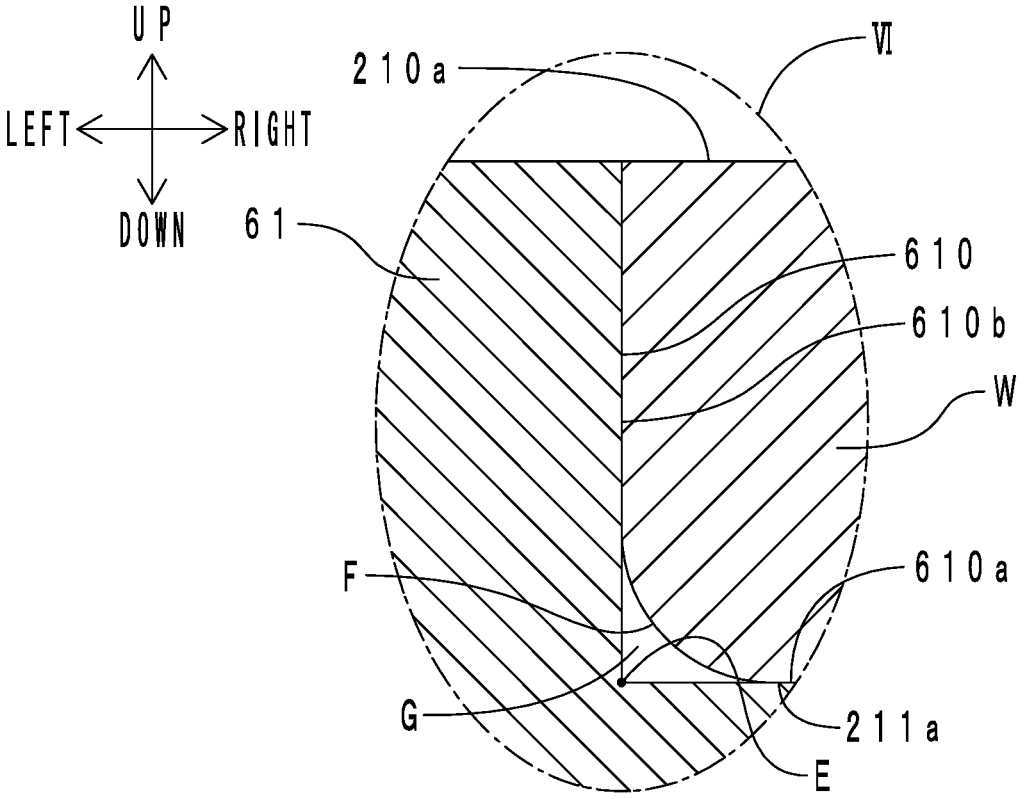
FIG. 6 is an enlarged view of the inside of a circle VI in FIG. 5.

FIG. 6 is an enlarged view of the inside of a circle VI in FIG. 5. As shown in FIG. 6, a right angle corner portion E is formed in the boundary between the bottom surface 610*a* and an inner peripheral surface 610*b* of the recessed portion 610. A sag F is formed on the outer edge of the inner surface 211*a* of the workpiece W. Thus, a gap G is formed between the sag F and the corner portion E.

Figure 7:
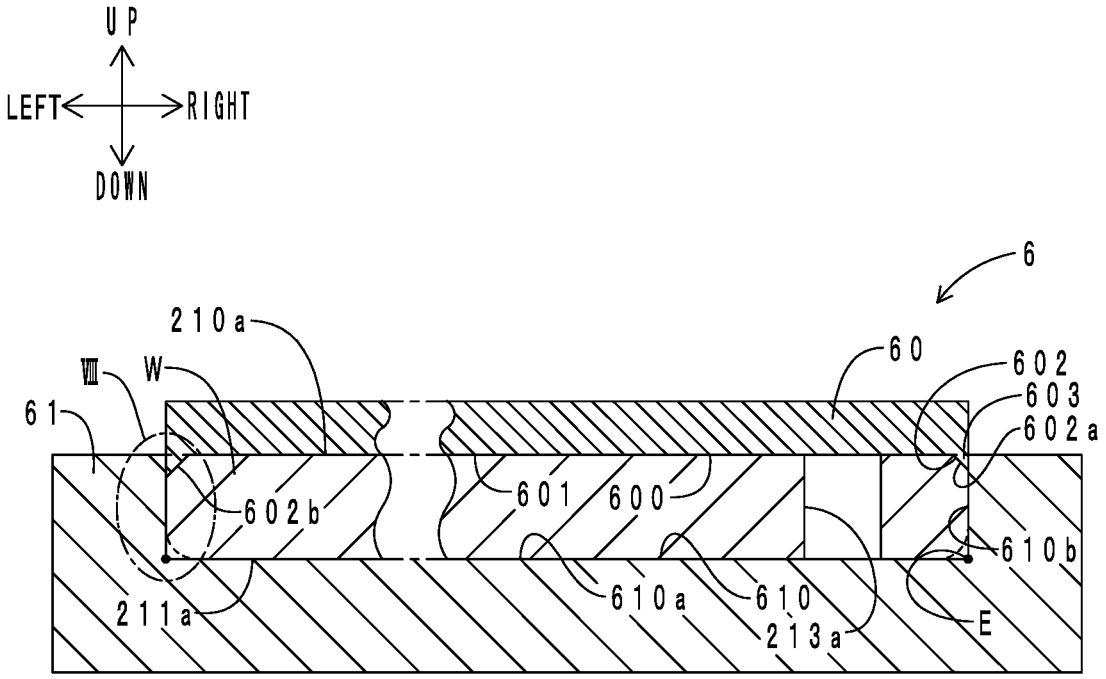
FIG. 7 is a schematic diagram of a filling step of the manufacturing method.

FIG. 7 is a schematic diagram of a filling step of the manufacturing method of an end plate of the present embodiment. In this step, as shown in FIG. 7, the outer surface 210*a* of the workpiece W is pressed by the pressing member 60. The uneven pattern of the flat surface portion 601 is transferred to the portion of the outer surface 210*a* that is pressed by the flat surface portion 601. The bottom surface 610*a* of the recessed portion 610 has a flat surface. Thus, the flatness of the inner surface 211*a* is improved.

Figure 8:
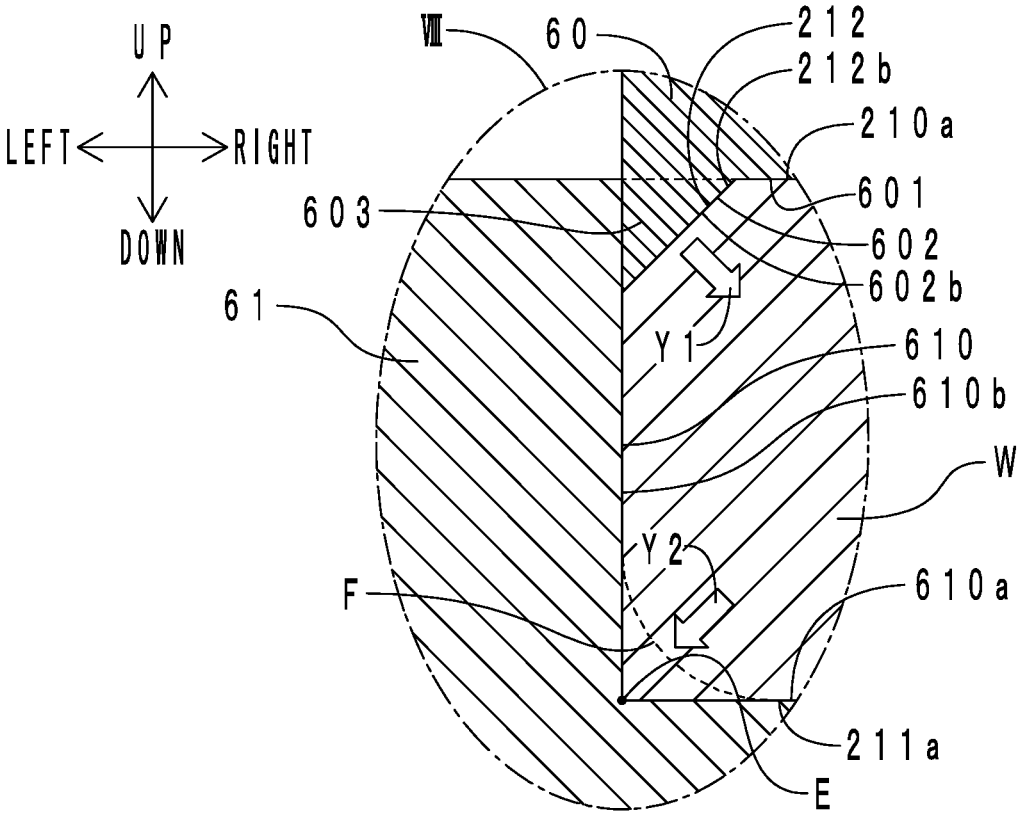
FIG. 8 is an enlarged view of the inside of a circle VIII in FIG. 7.

FIG. 8 is an enlarged view of the inside of a circle VIII in FIG. 7. As shown in FIG. 8, the protruded portion 603 of the pressing member 60 presses the outer edge of the outer surface 210*a* of the workpiece W. The material in the outer edge portion of the workpiece W is thus pushed into the inner portion (the lower side and the radial inner side) of the workpiece W, as shown by an arrow Y1 in FIG. 8. Thus, the pressed trace surface 212 shown in FIG. 1 is formed on the outer edge of the outer surface 210*a* of the workpiece W. Specifically, the fastening section 212*a* shown in FIG. 3 is formed by the fastening section forming portion 602*a*. The non-fastening section 212*b* shown in FIG. 3 is formed by the non-fastening section forming portion 602*b*.

In the recessed portion 610 in which the workpiece W is already housed, the gap G is ensured only between the sag F and the corner portion E. Thus, as shown by an arrow Y2 in FIG. 8, the material corresponding to the portion pushed in fills the gap G (see FIG. 6) along the shape of the corner portion E. In this way, the sag F is removed. Afterwards, the workpiece W is taken out of the recessed portion 610, the workpiece W is subjected to a prescribed finishing step, and the end plate 21 shown in FIG. 1 is completed.

<Operation and Effects>

Next, the operation and effects of the manufacturing method of an end plate and a vane pump of the present embodiment will be described. As shown in FIG. 8, in the manufacturing method of an end plate of the present embodiment, the material of the workpiece W can fill the gap G shown in FIG. 6 by deforming the material of the workpiece W near the cut end surface, when the pressed trace surface 212 is formed in the pressing step. Thus, the sag F can easily be removed.

As shown in FIG. 3, in the vane pump of the present embodiment, the sag hardly remains on the outer edge of the inner surface 211 of the end plate 21. Thus, a gap that reaches the sealing member 92 is hardly formed on a mating surface (sealing surface) H between the inner surface 211 of the end plate 21 and the opening portion 202 of the housing body 20. Therefore, the sealability of the mating surface H can be easily ensured.

If the sag remains in the outer edge of the inner surface 211 of the end plate 21, the sealing member 92 needs to be shifted to the radial inner side in order to avoid interference of the sag with the sealing member 92. The capacity of the pump chamber A will therefore decrease. However, in the vane pump 1 of the present embodiment, the sag hardly remains on the outer edge of the inner surface 211 of the end plate 21. Thus, there is no need to avoid interference of the sag with the sealing member 92. Therefore, the capacity of the pump chamber A can be increased. In other words, compared to the vane pump in which the sag remains on the outer edge of the inner surface 211 of the end plate 21, it is possible to ensure a pump chamber A that has the same capacity, in a smaller vane pump 1.

As shown in FIG. 1, the pressed trace surface 212 is disposed radially outward of the sealing member 92 (a member for ensuring air-tightness of the pump chamber A) along the whole circumference in an endless ring shape. Thus, the sealability of the mating surface H can be easily ensured.

As shown in FIG. 1, the radial width (minimum value of the radial width) Ra of the fastening section 212*a* is shorter than the radial width (minimum value of the radial width) Rb of the non-fastening section 212*b*. Thus, a bearing surface of the bolt 90 can be easily ensured on the mounting seat 213. The radial width Rb of the non-fastening section 212*b* is long, that is, the pressing force of the non-fastening section forming portion 602*b* shown in FIG. 7 is large. Therefore, the material of the workpiece W can sufficiently fill the gap G shown in FIG. 6.

As shown in FIGS. 5 to 8, the pressing step includes the workpiece arrangement step, and the filling step. In the workpiece arrangement step, the workpiece W is disposed in the recessed portion 610 of the jig 61 so that the outer surface 210*a* is the surface side (upper side). In the filling step, the material of the workpiece W is filled in the gap G between the recessed portion 610 and the sag F along the shape of the recessed portion 610, while the pressed trace surface 212 is formed by pushing in the outer edge of the outer surface 210*a* into the inner portion of the workpiece W. In the recessed portion 610 in which the workpiece W is already housed, the gap G is ensured only between the sag F and the corner portion E. The material of the workpiece W is thus easily lead into the gap G Thus, the material of the workpiece W can easily be filled into the gap G.

Additionally, in the manufacturing method of the end plate 21 of the present embodiment, even if a flash (burr) occurs on the outer edge of the outer surface 210*a* of the workpiece W in the punching step shown in FIG. 4, the flash can be removed by pressing the flash with the protruded portion 603 of the pressing member 60 and forming the pressed trace surface 212 in the filling step shown in FIG. 8. In the filling step, the gap G can be sufficiently filled by the material of the flash being pushed into the inside portion of the workpiece W.

<Others>

The manufacturing method of an end plate of a pump of the present invention and the embodiment of the pump have been described. However, the embodiment is not specifically limited to the embodiment described above. Various modified and improved configurations that a person skilled in the art is capable of carrying out, may be implemented.

Figure 9:
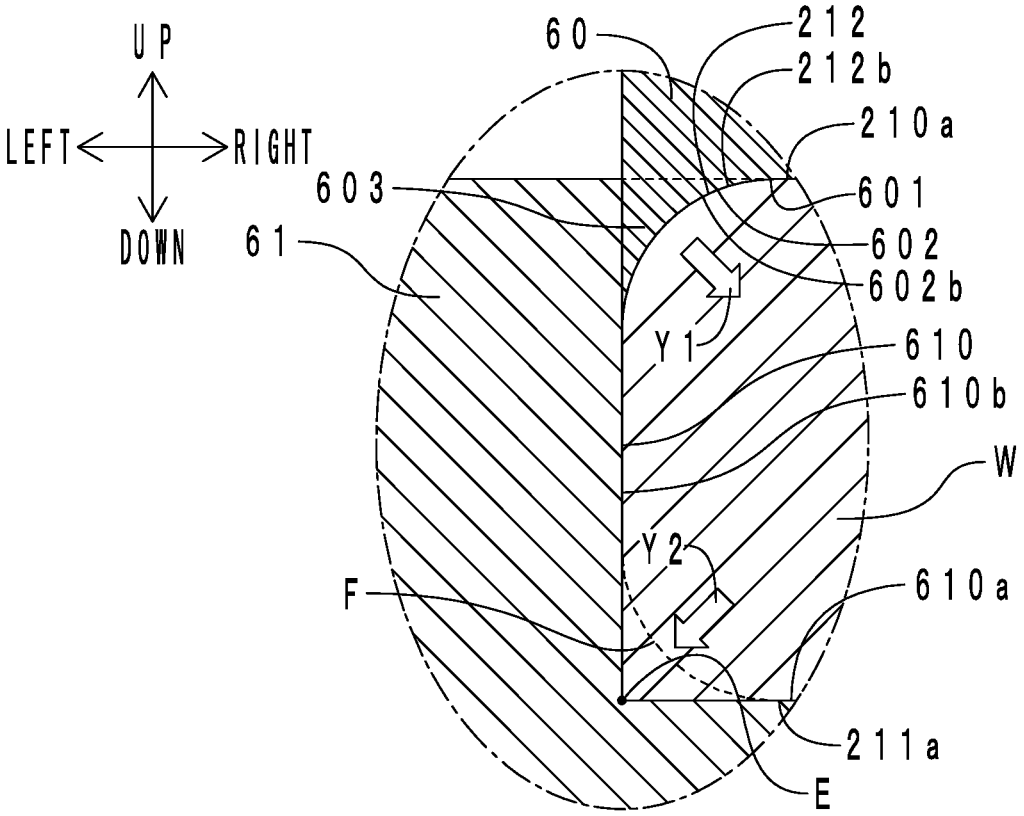
FIG. 9 is a partially enlarged view of a filling step of a manufacturing method of an end plate of a pump of another embodiment (1).

FIG. 9 is a partially enlarged view of the filling step of the manufacturing method of an end plate of another embodiment (1). The portions corresponding to those in FIG. 8 are denoted by the same reference signs. As shown in FIG. 9, the pressed trace surface forming portion 602 may have a round chamfered shape. In this case, the pressed trace surface 212 shown in FIG. 3 will have a round chamfered shape.

Figure 10:
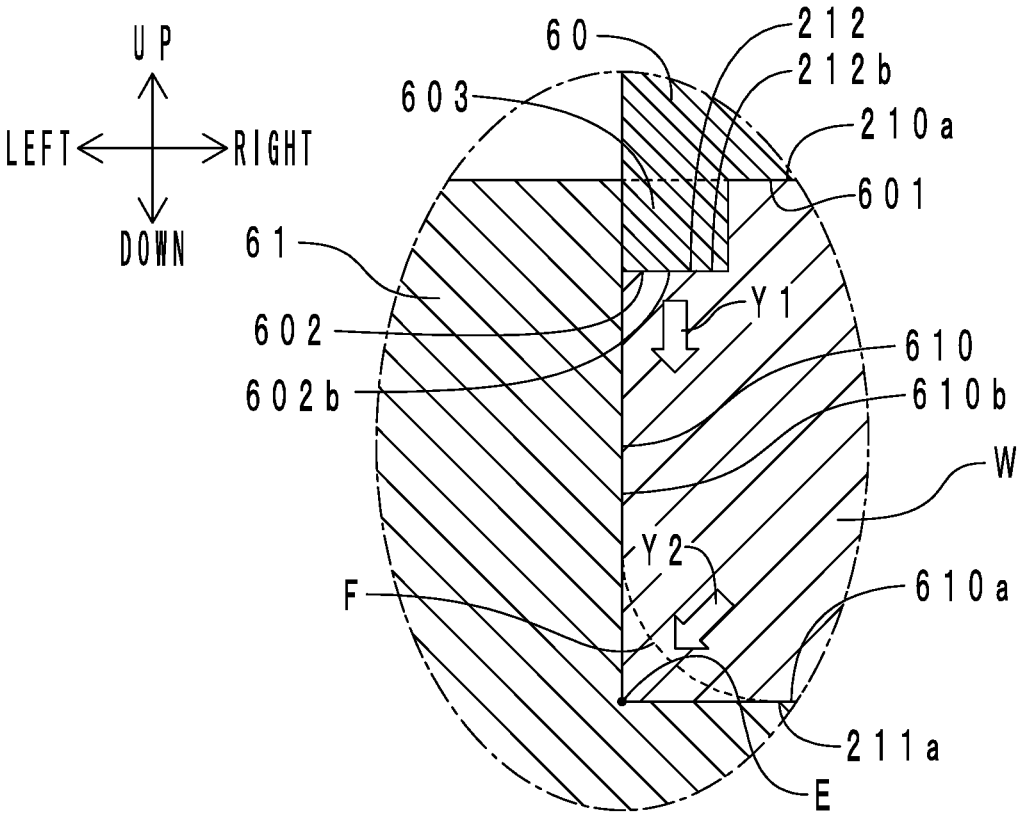
FIG. 10 is a partially enlarged view of a filling step of a manufacturing method of an end plate of another embodiment (2).

FIG. 10 is a partially enlarged view of the filling step of the manufacturing method of an end plate of another embodiment (2). The portions corresponding to those in FIG. 8 are denoted by the same reference signs. As shown in FIG. 10, the radial section of the protruded portion 603 may be rectangular. In this case, the pressed trace surface 212 shown in FIG. 3 will have a flat surface (step shape) that has a step shifted to the rear side from the outer surface 210.

The shape of the pressed trace surface forming portion 602 and the pressed trace surface 212 are not particularly limited to the embodiments described above. The pressed trace surface forming portion 602 and the pressed trace surface 212 may be a planar chamfered shape, a round chamfered shape, or a flat surface. The inclination of the pressed trace surface forming portion 602 to the flat surface portion 601 and the inclination of the pressed trace surface 212 to the outer surface 210 are not particularly limited to the embodiments described above. For example, the inclination may be 30°, 45°, or 60°.

In the punching step shown in FIG. 4, the punching direction of the punch 50 when the workpiece W is punched from the plate material B is not particularly limited to the embodiment described above. The punching direction may be downwards or upwards. A reciprocating blanking may also be used. Additionally, the number of times the punch 50 presses the workpiece W is not particularly limited to the embodiments described above.

The position that the sag F occurs in the punching step (for example, near the portion D that abuts on the rim of the punch insertion hole 510 shown in FIG. 4) and the size of the sag F are not particularly limited to the embodiments described above. The position that the sag F occurs and the size of the sag F differ due to the punching direction of the punch 50 and the size of the clearance C.

For example, the sag F may occur in at least one of the outer edge of the outer surface 210*a* and the outer edge of the inner surface 211*a* of the workpiece W shown in FIG. 4. If the sag F occurs in the outer edge of the outer surface 210*a* and the outer edge of the inner surface 211*a*, any surface of the outer surface 210 and the inner surface 211*a* that needs conditioning may be abutted on the bottom surface 610*a* of the recessed portion 610, during the workpiece arrangement step shown in FIG. 5 and FIG. 6.

In the pressing step (workpiece arrangement step and filling step) shown in FIGS. 5 to 8, a pressing member dedicated to the flat surface portion 601 and a pressing member dedicated to the pressed trace surface forming portion 602 may be prepared separately. In this case, pressing (flat pressing step) the outer surface 210*a* of the workpiece W by the flat surface portion 601, and forming the pressed trace surface 212 by the pressed trace surface forming portion 602, that is, filling the gap G (pressed trace surface forming step), may be carried out separately.

The pressing step shown in FIGS. 5 to 8, can be carried out independently of the manufacturing method of an end plate of the present invention, as a surface conditioning method which conditions the unevenness of the cut end surface of the sheared workpiece W. In this case, the unevenness due to the fracture surface and the flash (burr) may be conditioned as well as the sag of the cut end surface, by using the conditioning method.

In the case when the opening portion 202 of the housing body 20 is manufactured by shearing, the pressed trace surface 212 may be formed on the outer edge of the rear surface of the opening portion 202 shown in FIG. 2, by the pressing step shown in FIGS. 5 to 8. In this way, the sag F may be easily removed from the outer edge of the front surface of the opening portion 202 (the surface on the mating surface H side). Thus, the sealability of the mating surface H can be easily ensured.

The uneven pattern disposed on the flat surface portion 601 of the lower surface 600 of the pressing member 60 is not particularly limited to the embodiments described above. An appropriate uneven pattern may be disposed with the removal of the residual stress of the end plate 21 and the improvement of strength in mind. The flat surface portion 601 may have a flat surface that does not have an uneven pattern. In this way, the flatness of the outer surface 210 of the end plate 21 is improved.

The type of the pump of the present invention is not particularly limited to the embodiments described above. The pump may be a piston pump, a plunger pump, a diaphragm pump, or a rotary pump (a vane pump 1, a gear pump, or a screw pump). A compressor is also included in the pump. Thus, the pump chamber A which requires airtightness and fluid-tightness may be defined in the housing 2 of the pump.

DESCRIPTION OF THE REFERENCE NUMERALS

1: Vane pump (Pump)

2: Housing, 20: Housing body, 200: Peripheral wall portion, 201: Bottom wall portion, 201*d*: Exhaust hole, 202: Opening portion, 202*a*: Groove, 202*b*: Mounting seat, 202*c*: Insertion hole, 21: End plate, 210: Outer surface, 210*a*: Outer surface, 211: Inner surface, 211*a*: Inner surface, 212: Pressed trace surface, 212*a*: Fastening section, 212*b*: Non-fastening section, 213: Mounting seat, 213*a*: Insertion hole

3: Rotor, 30: Rotor body, 300*a*: Rotor groove, 31: Shaft portion

4: Vane, 40: Vane body, 41: Cap

5: Mold, 50: Punch, 51: Die, 510: Punch insertion hole, 52: Stripper

6: Mold, 60: Pressing member, 600: Lower surface, 601: Flat surface portion, 602: Pressed trace surface forming portion, 602*a*: Fastening section forming portion, 602*b*: Non-fastening section forming portion, 603: Protruded portion, 61: Jig, 610: Recessed portion, 610*a*: Bottom surface, 610*b*: Inner peripheral surface

90: Bolt (Fastener), 91: Nut, 92: Sealing member, 93: Intake cylinder A: Pump chamber, B: Plate material, C: Clearance, E: Corner portion, F: Sag, G: Gap, H: Mating surface, 0: Center, Ra: Radial width, Rb: Radial width, W: Workpiece

The invention claimed is:

1. A manufacturing method of an end plate of a pump, including a punching step of punching a workpiece from a plate material, the workpiece being the end plate that has a mounting seat in which a fastener is inserted, characterized by comprising a pressing step of forming a pressed trace surface by pressing an outer edge of an outer surface, when a surface, of both front and back surfaces of the punched workpiece, that is further from a sag that is formed on a cut end surface is the outer surface, and a surface, of both front and back surfaces of the punched workpiece, that is nearer to the sag is an inner surface, wherein a first section of the pressed trace surface which is disposed along an outer edge of the mounting seat is a fastening section and a second section of the pressed trace surface which is other than the fastening section is a non-fastening section, a width of the fastening section is shorter than a width of the non-fastening section, the pressed trace surface is arranged in an endless ring shape along the outer edge of the outer surface, and the mounting seat is arranged on the outer surface.

2. The manufacturing method of the end plate of the pump according to claim 1, wherein the pressed trace surface has a planar chamfered shape or a round chamfered shape.

3. A pump comprising:

a housing in which a pump chamber is defined, the housing including:

a cylindrical housing body that includes an opening portion in at least one end in an axial direction; and an end plate which has an inner surface that seals the opening portion, an outer surface that is disposed on the opposite side of the inner surface in the axial direction, and a pressed trace surface that is disposed on an outside of the outer surface along an outer edge of the outer surface, wherein the end plate includes a mounting seat in which a fastener is inserted, a first section of the pressed trace surface which is disposed along an outer edge of the mounting seat is a fastening section and a second section of the pressed trace surface which is other than the fastening section is a non-fastening section, a width of the fastening section is shorter than a width of the non-fastening section, the pressed trace surface is arranged in an endless ring shape along the outer edge of the outer surface, and the mounting seat is arranged on the outer surface.

4. The pump according to claim 3, herein the pressed trace surface has a planar chamfered shape or a round chamfered shape.

5. The pump according to claim 3, further comprising:

a ring-shaped sealing member arranged in the opening portion of the cylindrical housing body, wherein the pressed trace surface is disposed radially outward of the sealing member.

* * * * *